United States Patent [19]

Bond et al.

[11] Patent Number: 4,500,351

[45] Date of Patent: Feb. 19, 1985

[54] CAST DUPLEX STAINLESS STEEL

[75] Inventors: Armand P. Bond, Livonia; Abraham Poznansky; Paul J. Grobner, both of Ann Arbor, all of Mich.

[73] Assignee: Amax Inc., Greenwich, Conn.

[21] Appl. No.: 583,903

[22] Filed: Feb. 27, 1984

[51] Int. Cl.[3] ..... C22C 38/42

[52] U.S. Cl. ..... 75/128 N; 75/128 W; 75/128 R; 148/37; 148/38

[58] Field of Search ..... 148/37, 38; 75/128 W, 75/128 N

[56] References Cited

U.S. PATENT DOCUMENTS

| | | | |
|---|---|---|---|
| 4,032,367 | 6/1977 | Richardson et al. | 75/128 W |
| 4,101,347 | 7/1978 | Fujikura et al. | 148/38 |
| 4,390,367 | 6/1983 | Niehaus et al. | 148/37 |

FOREIGN PATENT DOCUMENTS

| | | | |
|---|---|---|---|
| 50-4172 | 2/1975 | Japan | 75/128 N |

*Primary Examiner*—L. Dewayne Rutledge
*Assistant Examiner*—Debbie Yee
*Attorney, Agent, or Firm*—Michael A. Ciomek; Eugene J. Kalil

[57] ABSTRACT

A casting alloy is provided containing about 0.02% to 0.05% carbon, about 23% to about 25% chromium, about 8% to 12% nickel, about 5% to 7% molybdenum, about 0.4% to 0.8% manganese, about 0.1% to 0.3% silicon, about 0.1% to 0.4% nitrogen, and the balance essentially iron, the alloy having a duplex austenite-ferrite grain structure, and being resistant to the corrosive effects of acids, chloride solutions and seawater.

3 Claims, No Drawings

CAST DUPLEX STAINLESS STEEL

The invention is directed to cast stainless steels having a duplex ferrite-austenite microstructure and having an improved combination of properties including, in particular, corrosion resistance.

BACKGROUND OF THE INVENTION AND THE PRIOR ART

Cast stainless steels having a duplex ferrite-austenite structure and containing about 0.08% carbon (max), about 0.1% to 0.4% nitrogen, about 20% to 27% chromium, about 4.5% to 7.5%, nickel, about 2% to 4% molybdenum, with optionally, small additions of copper and/or tungsten, balance essentially iron, have been known. An example is an alloy containing 0.08% carbon (max), 24–27% chromium, 4.5% to 6.5% nickel, 1.3% to 4% copper, 2% to 4% molybdenum, 0.10% nitrogen (min.), balance iron. This alloy is known as "Ferralium". Castings made of such alloys are used in pumps, valves and other parts exposed in service to aggressive liquids such as acids, chlorides and seawater. As is customary in the art, demands have arisen for castings having improved combinations of properties including, in particular, corrosion resistance.

SUMMARY OF THE INVENTION

A cast stainless steel having a duplex ferrite-austenite structure contains about 0.02% to about 0.05% carbon, about 23% to about 25% chromium, about 8% to about 11% nickel, about 5% to about 7% molybdenum, about 0.2% to about 0.8% manganese, about 0.1% to about 0.3% silicon, about 0.1% to about 0.4% nitrogen and the balance essentially iron and has improved corrosion resistance. In particular, resistance to pitting and crevice corrosion in chloride solutions is improved.

DETAILED DESCRIPTION OF THE INVENTION

Alloys having compositions within the aforesaid range may contain small amounts of other elements and of impurities. For example, up to about 0.5% copper, up to about 0.1% tungsten, up to about 0.1% of cerium may be present without detriment. Impurities such as phosphorus and sulfur are usually present unavoidably in amounts of about 0.01% to 0.03% each. Representative castings will contain by weight about 0.02% carbon, about 24% chromium, about 9.5% nickel, about 6% molybdenum, about 0.5% manganese, about 0.2% silicon, about 0.25% nitrogen and the balance essentially iron. Such an alloy, in the form of a casting having section thickness of about 0.1 to about 3 inches will, after a solution treatment at 1200° C. for $\frac{3}{4}$ hours per inch of section and a rapid cool, e.g., a water or oil quench, have a yield strength of 77 ksi (531 MPa), a tensile strength of 119 ksi (820 MPa) an elongation of 33% and a reduction in area of 70%. The room temperature impact energy as measured by the full-size charpy V-notch specimen is 130 ft. lb. (176 J). The casting is characterized by a microstructure comprising about 50% austenite in a ferritic matrix. When subjected to anodic polarization tests, no pitting was observed in 1M NaCl solution at either 50° C. or 78° C. The critical crevice temperature in 10%, by weight, ferric chloride solution ($FeCl_3.6H_2O$) above which the alloy becomes susceptible to crevice corrosion was 47.5° C., as compared to 12.5° C., for the aforementioned Ferralium alloy.

Alloys having the compositions set forth in the following table 1 were produced in a 100 lb furnace and cast to product test blocks having a minimum section size of $\frac{5}{8}$ inches.

TABLE 1

| Alloy No. | % C | % Cr | % Ni | % Mo | % Mn | % Si | % N |
|---|---|---|---|---|---|---|---|
| 1 | 0.021 | 24.26 | 9.70 | 5.72 | 0.51 | 0.18 | 0.27 |
| 2 | 0.022 | 24.29 | 9.86 | 6.25 | 0.24 | 0.11 | 0.30 |
| 3 | 0.022 | 24.22 | 9.84 | 6.10 | 0.24 | 0.24 | 0.30 |

Note:
The balance of the castings was iron, including 0.014% phosphorus and 0.014% sulfur as impurities.

The castings were solution treated at 1200° C. and rapidly cooled by water quenching. Room temperature tensile properties obtained upon the thus-treated castings were determined with the results set forth in Table 2.

TABLE 2

| Alloy No. | Yield Strength (ksi) | Tensile Strength (ksi) | % EL | % R.A. |
|---|---|---|---|---|
| 1 | 82 | 116 | 33 | 70 |
| 2 | 77 | 118 | 33 | 65 |
| 3 | 72 | 115 | 40 | 71 |

The alloys were found to be immune to pitting in anodic polarization with tests conducted in 1M NaCl at 50° C. and 78° C. The critical crevice temperature in 10% ferric chloride solution was 47.5° C., 42.5° C., and 55° C. for alloys 1 to 3 respectively.

It is important, particularly in terms of corrosion resistance, that castings according to the invention have a microstructure comprising a ferritic matrix containing at least about 30%, preferably about 40% to about 55% austenite after the solution treatment as aforedescribed. To attain this result, the composition is balanced within the ranges set forth hereinbefore in terms of the principal ingredients carbon, chromium, nickel, molybdenum and nitrogen in accordance with the relationship $$0.85 > \frac{\%\ Ni + 30\%\ C + 25\%\ N + 1}{\%\ Cr + 1.5\%\ Mo - 10} > 0.68$$

It is found that when austenite is less than about 40% in the microstructure reduction of toughness occurs, while, when austenite exceeds 60% in the microstructure, stress corrosion cracking resistance is reduced. Either effect is undesirable. Ferrite is the continuous phase in the microstructure. The castings are solution treated at temperatures in the range of 1160° to 1240° C. Preferably, the solution treating temperature is about 1200° C. or higher to avoid the formation of sigma phase.

Castings provided in accordance with the invention are useful in pump parts such as impellers and housings, in valve parts such as seats and gates and in other applications in which resistance to aggressive media such as acids, chlorides and sea water is required. Such parts also resist the erosive action of suspended hard particles such as sand in the solutions being handled.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A casting made of an alloy consisting essentially of about 0.02% to 0.05% carbon, about 23% to about 25% chromium, about 8% to 12% nickel, about 5% to 7% molybdenum, about 0.4% to 0.8% manganese, about 0.1% to 0.3% silicon, about 0.1% to 0.4% nitrogen, up to about 0.5% copper, up to about 0.1% tungsten, up to about 0.1% cerium and the balance essentially iron, said alloy being resistant to the corrosive effects of acids, chloride solutions and seawater, said alloy having a microstructure consisting essentially of about 40% to about 55% austenite in a continuous matrix of ferrite and having a composition balanced in accordance with the relationship:

$$0.85 > \frac{\%\ \text{Ni} + 30\%\ \text{C} + 25\%\ \text{N} + 1}{\%\ \text{Cr} + 1.5\%\ \text{Mo} - 10} > 0.68.$$

2. An alloy consisting essentially of about 0.2% to about 0.5% carbon, about 23% to about 25% chromium, about 8% to about 12% nickel, about 5% to 7% molybdenum, about 0.2% to about 0.8% manganese, about 0.1% to about 0.3% silicon, about 0.1% to about 0.4% nitrogen and the balance essentially iron, said alloy having a microstructure consisting essentially of about 40% to about 55% austenite in a continuous matrix of ferrite and having a composition balanced in accordance with the relationship:

$$0.85 > \frac{\%\ \text{Ni} + 30\%\ \text{C} + 25\%\ \text{N} + 1}{\%\ \text{Cr} + 1.5\%\ \text{Mo} - 10} > 0.68.$$

3. A corrosion resistant alloy consisting essentially of, by weight, about 0.02% carbon, about 24% chromium, about 9.5% nickel, about 6% molybdenum, about 0.5% manganese, about 0.2% silicon, about 0.25% nitrogen and the balance essentially iron, said alloy in the solution-treated condition, having a microstructure consisting essentially of about 50% austenite in a continuous matrix of ferrite.

* * * * *